US009303870B2

(12) United States Patent
Abeyta

(10) Patent No.: US 9,303,870 B2
(45) Date of Patent: Apr. 5, 2016

(54) SYSTEM AND METHOD FOR INJECTING COMPOUND INTO UTILITY FURNACE

(75) Inventor: Christopher L. Abeyta, Farmington, NM (US)

(73) Assignee: Power & Control Solutions, Inc., Farmington, NM (US)

( * ) Notice: Subject to any disclaimer, the term of this patent is extended or adjusted under 35 U.S.C. 154(b) by 472 days.

(21) Appl. No.: 13/492,479

(22) Filed: Jun. 8, 2012

(65) Prior Publication Data

US 2012/0247405 A1 Oct. 4, 2012

Related U.S. Application Data

(63) Continuation-in-part of application No. PCT/US2010/059886, filed on Dec. 10, 2010, which is a continuation-in-part of application No. 12/636,466, filed on Dec. 11, 2009, now Pat. No. 8,817,202.

(51) Int. Cl.
*F22B 37/54* (2006.01)
*F28G 9/00* (2006.01)
*F23J 3/02* (2006.01)

(52) U.S. Cl.
CPC ..... *F23J 3/023* (2013.01)

(58) Field of Classification Search
CPC ..... F28G 11/00; F28G 1/16; F28G 9/00; F23L 9/00; F23J 3/023
USPC ..... 122/390, 396, 401, 395
See application file for complete search history.

(56) References Cited

U.S. PATENT DOCUMENTS

| | | | | | |
|---|---|---|---|---|---|
| 860,523 | A | | 7/1907 | Canales | |
| 1,377,622 | A | | 5/1921 | Kemnal et al. | |
| 1,529,055 | A | * | 3/1925 | Dorsey | 15/3.5 |
| 1,652,845 | A | | 12/1927 | Vennum | |
| 2,897,532 | A | | 8/1959 | Cantieri | |
| 3,221,994 | A | | 12/1965 | Chappell | |
| 3,439,376 | A | | 4/1969 | Nelson et al. | |
| 3,817,722 | A | | 6/1974 | Scott | |
| 3,837,820 | A | | 9/1974 | Kukin | |
| 4,229,854 | A | | 10/1980 | Johnston | |
| 4,368,677 | A | * | 1/1983 | Kline | 110/212 |
| 4,421,067 | A | * | 12/1983 | Krowech | 122/390 |
| 4,456,635 | A | * | 6/1984 | Albanese et al. | 427/230 |
| 4,545,411 | A | * | 10/1985 | Wierzba et al. | 141/91 |
| 4,616,574 | A | | 10/1986 | Abrams et al. | |
| 4,996,032 | A | | 2/1991 | Stowe, Jr. et al. | |
| 5,355,844 | A | * | 10/1994 | Kendrick | 122/390 |
| 5,585,072 | A | * | 12/1996 | Moskal et al. | 422/168 |

(Continued)

FOREIGN PATENT DOCUMENTS

WO 2011072222 6/2011

OTHER PUBLICATIONS

International Preliminary Report on Patentability dated Jun. 21, 2012 in Application PCT/US2010/059886.

(Continued)

*Primary Examiner* — Alissa Tompkins
*Assistant Examiner* — Benjamin W Johnson
(74) *Attorney, Agent, or Firm* — Snell & Wilmer L.L.P.

(57) ABSTRACT

This disclosure may relate generally to systems, devices, and methods for a injecting a solid compound in line with a pressurized fluid, through a sootblower burner or other utility furnace hardware, such that the compound can be delivered to targeted areas on the inside of a utility furnace.

9 Claims, 14 Drawing Sheets

(56) References Cited

U.S. PATENT DOCUMENTS

| | | | | |
|---|---|---|---|---|
| 6,289,827 | B1 | 9/2001 | Wajer et al. | |
| 6,363,869 | B1 | 4/2002 | Ashworth | |
| 2004/0018133 | A1 | 1/2004 | Radway | |
| 2005/0063887 | A1 | 3/2005 | Arrol et al. | |
| 2006/0121398 | A1 | 6/2006 | Meffert et al. | |
| 2007/0119351 | A1 * | 5/2007 | Widmer et al. | 110/342 |
| 2007/0119352 | A1 | 5/2007 | Martin et al. | |
| 2009/0047199 | A1 * | 2/2009 | Arrol et al. | 423/210 |
| 2010/0263577 | A1 | 10/2010 | Nijhawan | |
| 2011/0132282 | A1 | 6/2011 | Abeyta | |
| 2014/0026827 | A1 | 1/2014 | Abeyta | |

OTHER PUBLICATIONS

Restriction Requirement dated Feb. 29, 2012 in U.S. Appl. No. 12/636,446.

Non-Final Office Action dated Aug. 16, 2012 in U.S. Appl. No. 12/636,446.

International Search Report and Written Opinion dated Dec. 6, 2013 in PCT/US2013/044296.

Final Office Action dated Jun. 28, 2013 in U.S. Appl. No. 12/636,446.

Watts, J.U., Mann, A.N. and Russell, Sr., D.L., "An Overview of NOx Control Technologies Demonstrated under the Department of Energy's Clean Coal Technology Program," American Institute of Chemical Engineers Conference, New Orleans, LA, Mar. 1998, pp. 1-8.

USPTO; Notice of Publication mailed Jun. 9, 2011 in corresponding U.S. Appl. No. 12/636,446.

WIPO; International Search Report and Written Opinion mailed Aug. 23, 2011 in corresponding International Application No. PCT/US2010/059886.

USPTO; Office Communication mailed Jan. 24, 2013 in corresponding U.S. Appl. No. 12/636,446.

WIPO; International Preliminary Report on Patentability mailed Dec. 9, 2014 in corresponding International Application No. PCT/US2013/044296.

USPTO; Applicant-Initiated Interview Summary mailed Nov. 2, 2015 in corresponding U.S. Appl. No. 14/040,411.

USPTO; Notice of Publication mailed Mar. 26, 2015 in corresponding U.S. Appl. No. 14/562,276.

USPTO; Notice of Publication mailed Apr. 2, 2015 in corresponding U.S. Appl. No. 14/563,648.

USPTO; Office Action mailed Aug. 11, 2015 in corresponding U.S. Appl. No. 14/040,411.

* cited by examiner

SYSTEM AND METHOD FOR INJECTING COMPOUND INTO UTILITY FURNACE

CROSS-REFERENCE TO RELATED APPLICATIONS

This application is a continuation-in-part and claims priority to PCT App. No. PCT/US2010/059886 filed on Dec. 10, 2010, and entitled SYSTEM AND METHOD FOR INJECTING COMPOUND INTO UTILITY FURNACE, which designates the United States and is itself a PCT filing of and claims priority to, U.S. Ser. No. 12/636,446 filed on Dec. 11, 2009, and entitled SYSTEM AND METHOD FOR INJECTING COMPOUND INTO UTILITY FURNACE, both of which are incorporated herein by reference in their entirety.

FIELD OF INVENTION

The subject of this disclosure may relate generally to systems, devices, and methods for facilitating the injection of various compounds into a utility furnace.

BACKGROUND OF THE INVENTION

Utility furnaces are used in various industries for a variety of different purposes. Common issues associated between these various industries include the handling of the byproducts created by the combusted fuel. These byproducts can decrease the utility furnace efficiency and pose other pollution problems.

In one example, the pulverized coal, used in various types of boilers, burns in a combustion chamber. The hot gaseous combustion products then follow various paths, giving up their heat to steam, water and combustion air before exhausting through a stack. The boiler is constructed mainly of interconnected elements such as cylinders such as the super heater tubes, water walls, various larger diameter headers, and large drums. Water and steam circulate in these elements, often by natural convection, the steam finally collecting in the upper drum, where it is drawn off for use. Water/steam tubes typically almost completely cover the walls of the passage so that they efficiently transfer heat to the water/steam. As the coal is burned, ash and/or other products of combustion build-up on the tubes.

Presently sootblowers are available to aid in the removal of these build-ups. Soot blowers are mechanical devices used for on-line cleaning of ash and slag deposits on a periodic basis. They direct a pressurized fluid through nozzles into the soot or ash accumulated on the heat transfer surface of boilers to remove the deposits and maintain the heat transfer efficiency. The soot and dust generated in combustion get deposited on outer tube surfaces. This adds to the fuel requirements to maintain heat transfer into the water/steam heated by the utility furnace. Running with added fuel in turn increases deposition of byproducts of fuel burning and also increases the chances of the tubes failure by overheating. This eventually results in shutting down of the furnace for repairs. All this can be avoided by soot blowing. Regular soot blowing saves fuel and boiler downtime. In other words steam at constant parameters is available over a longer period of time. Numerous types of sootblowers exist including but not limited to wall sootblower, long retractable sootblower, rotating element sootblower, helical sootblower, and Rake-type blower. Under optimal conditions this ash is removed from the surface of the tubes by pressured fluid (typically air, saturated steam or super-heated steam) delivered from sootblowers. However under suboptimal conditions the ash melts due to reaching its fusion temperature and results in the formation of slag. Sootblowers are less effective at removing the slag.

The major problem with the formation of slag is that it insulates the elements, thus requiring the furnace to burn at a hotter temperature to create the same increase in water temperature. Excessive ash deposits on a coal-fired boiler's heat transfer surfaces will reduce its efficiency, and in extreme cases a boiler can be shut down by ash-related problems. Slagging incidents are a heavy drag on the global utility industry due to reduced power generation and equipment maintenance.

The changing electricity market and political pressures have pushed the use of fuels other than coal. For example, use of gas, biofuel, cofired fuel, etc. has become widespread. These factors have led to coal-fired plants being operated under unusual loads. This change in operation has altered the effects of boiler slagging. The cofiring of other fuels with coal, especially biomass, represents a large challenge to utility furnace operation. The ash chemistry of these alternative fuels is often very different to that of the coals and has given rise to serious problems. The tendency of coal for slagging depends on its composition. The complex interaction between a boiler's operating conditions and the fuel chemistry makes the prediction of slagging difficult. Furthermore, the increasing pressure on coal-fired power stations to reduce emissions has led to the development of technologies for the abatement of specific pollutants that impact on ash slagging. The new generation of pulverized coal fired plant, designed for high efficiency through the use of high steam temperatures and pressures, present further challenges with respect to ash slagging and fouling.

Various methods of removing the slag other than with a sootblower are in use. For example in some power plants, engineers fire shotguns into the furnace to break the slag off of the pipes. Other methods require taking the furnace off line to deal with the problem. Other methods include a specialized system that is located to access flue gasses whereby the system uses a specialized pressure source (i.e. different from that used by the facility for the operation of the sootblowers) to force a fluid into a feed tube, which mixes the fluid with a chemical coming from atomizing nozzles. The fluid and chemical is then injected into the flue gas stream which may allow incidental contact with areas affected by slagging. However, this method requires enormous amounts of chemical to be dumped into the flue gas stream which is difficult if not impossible to understand as the flow dynamics in the furnace are constantly changing. For example, the buildup of slag between tubes redirects the flue gas away from those tubes preventing the slag from receiving the chemical. Furthermore, the specialized equipment and the special access for introducing the chemicals from a specialized system into the utility furnace substantially increases cost. Thus, these techniques are less than satisfactory.

In dealing with the byproducts released into the environment (pollution), various systems associated with the utility furnaces process the byproducts before their release. However, better methods of chemical processing of these byproducts are constantly sought after. New utility furnaces are almost certain to be required to operate under conditions that facilitate carbon capture and storage, for compliance with climate change driven requirements. While such requirements are frequently sought in relation to coal fired furnaces they could also apply to a variety of fuel types.

While the problems and limitations of utility furnaces are clear, there are few solutions. The presence of certain compounds in the utility furnaces have been experimented with and resulted in improved abilities to deal with slag and pollution. While the specific compounds vary across the board depending on the specific chemistry of the fuel and problem to be addressed, one uniform problem exists, there is no adequate delivery mechanism to inject the compounds into targeted spots in the furnace.

A solution to the problem of delivering various compounds to targeted locations of a utility furnace is needed. As such a solution to the delivery of compounds into a utility furnace is presented herein.

SUMMARY OF THE INVENTION

In accordance with various aspects of the present invention an apparatus comprises a mixing chamber configured to receive a compound for improving environmental and/or efficiency conditions in a utility furnace, wherein the mixing chamber is further configured to mix the compound with a fluid which is in a pressurized fluid system in place with the utility furnace and configured to infect the fluid and compound into a utility furnace.

In another exemplary embodiment, a system comprises a fluid supply configured to deliver a fluid; a valve connected to the fluid supply wherein the valve is operable to control the fluid from the fluid supply; a feed tube configured to connect to the valve and transport the fluid; a delivery device configured to connect to the feed tube and configured to eject the fluid into a utility furnace; a compound capable of improving the efficiency of the utility furnace; a hopper configured to hold a quantity of the compound; an delivery system connected to the hopper and operable to transfer compound from the hopper; and a mixing chamber operable to receive the compound from the delivery system and combine the compound with the fluid supply wherein, the mixing chamber is configured to be removably connected to the valve.

In another exemplary embodiment, a system comprises a fluid supply configured to deliver a fluid; a valve connected to the fluid supply wherein the valve is operable to control the fluid from the fluid supply; a delivery system configured to connect to the fluid supply; a compound capable of improving the efficiency of the utility furnace; a mixing chamber operable to receive the compound from the delivery system and combine the compound with the fluid supply; the mixing chamber located in line with the fluid supply; the fluid supply delivering a mixture of fluid and compound to the air blowers of a burner, the air blowers connected in line to the fluid supply configured to relapse the mixture into the furnace.

Furthermore, in an exemplary embodiment a method comprises attaching a mixing chamber inline with a fluid supply; delivering a compound to the mixing chamber mixing the compound with the fluid supply forming a mixture; delivering the mixture to a utility furnace through a manufactured sootblower; covering areas of the furnace accessible by sootblowers; and impregnating the compound to affected slagging areas regardless of changing flue gas flow dynamics.

Furthermore, in an exemplary embodiment a method comprises attaching a mixing chamber inline with a fluid supply; delivering a compound to the mixing chamber mixing the compound with the fluid supply forming a mixture; delivering the mixture to a utility furnace through a burner; covering areas of the furnace accessible by the furnace; and impregnating the compound to affected slagging areas.

BRIEF DESCRIPTION OF THE DRAWINGS

These and other features, aspects, and advantages will become better understood with reference to the following description, claims and accompanying drawings where:

DETAILED DESCRIPTION

In accordance with an exemplary embodiment of the present invention, systems, devices, and methods are provided, for among other things, facilitating the injection of various compounds into a utility furnace. The following descriptions are not intended as a limitation on the use or applicability of the invention, but instead, are provided merely to enable a full and complete description of exemplary embodiments.

In accordance with various exemplary embodiments of the present invention, a compound may be injected into a utility furnace by mixing with a pressurized fluid going into the utility furnace. In various examples the compound may be merely injected under pressure into the pressurized fluid. In various embodiments the system may be configured to pull the compound into the fluid. These examples may be combined as well. As will be discussed herein the terms nozzles and/or mixing chambers may be used to describe the devices, locations and situations in which compound and the pressurized fluid are mixed. While each term may be discussed in various examples and embodiments it is noted that either term may be used without excluding the other from application in the examples and embodiments.

Figure 4A:
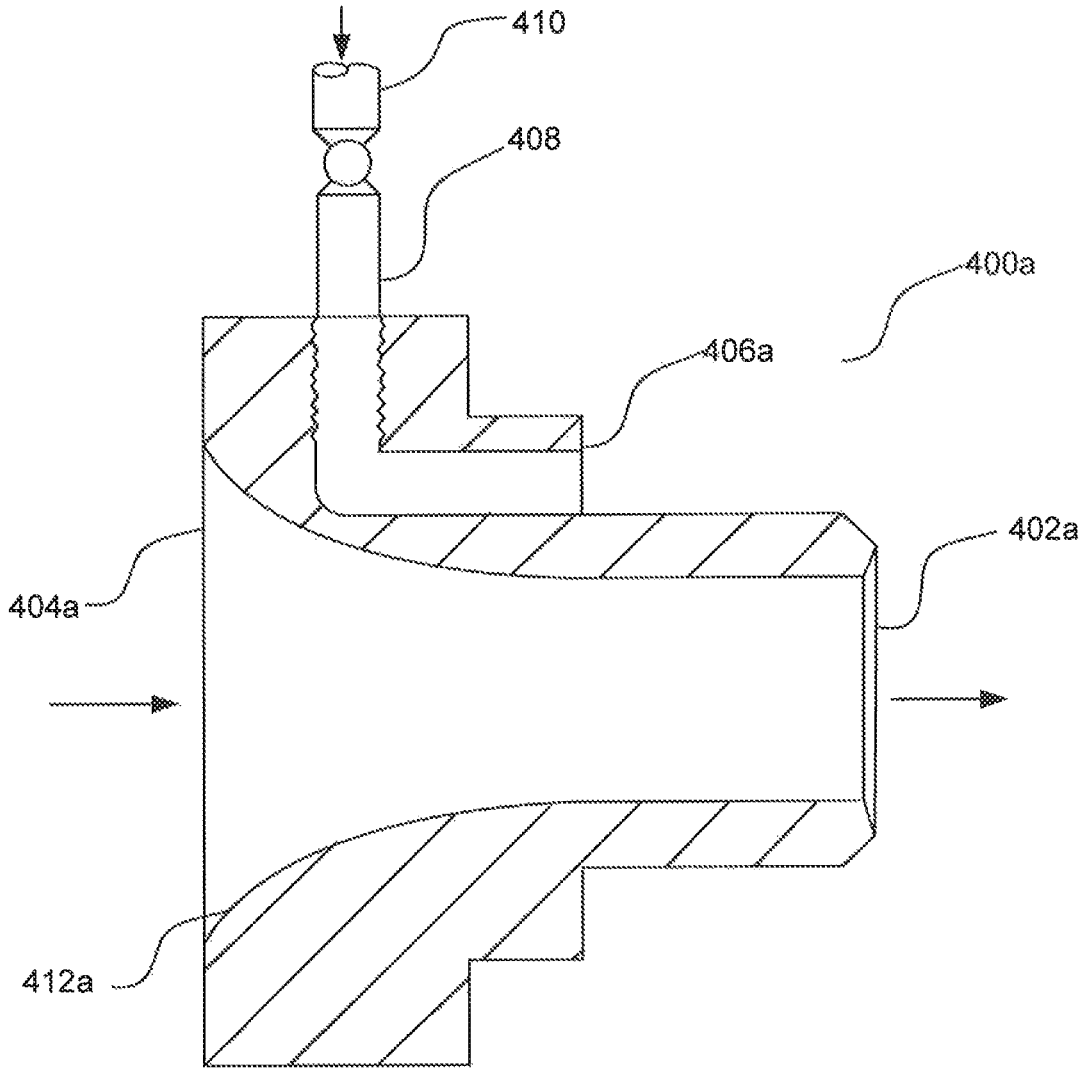
FIG. 4*a* is a cross section of an exemplary embodiment of a nozzle used to mix various compounds and pressurized fluid.

In accordance with an exemplary embodiment, with reference to FIG. 4*a*, nozzle 400*a* may have a first side 404*a*, an inlet side to the fluid, and a second side 402*a*, an exit side to the fluid. Nozzle 400*a* may be variously sized to accommodate the equipment that it mates to. In one exemplary embodiment nozzle 400*a* may be approximately 1-3 inches in diameter at the outlet to accommodate common feed tube sizes used with utility furnaces. However, nozzle 400*a* can be sized to fit various components. In accordance with one embodiment, nozzle 400*a* may have a varying cross-section between the first side and the second side. In various embodiments, the varying cross-section of the nozzle may comprise a long radius 412*a*. The long radius may have its largest opening in the nozzle on first side 404*a* and the smallest diameter cross-section on second side 402*a*. In accordance with an exemplary embodiment, nozzle 400*a* comprises a varying the cross section that causes a high pressure on first side 404*a* relative to a low pressure on the second side 402*a*.

The nozzle may also have a compound entrance 408. In an exemplary embodiment, the compound may be brought into nozzle 400*a* via compound entrance 408. Nozzle 400*a* may also have a compound exit 406 (also referred to herein as chemical injection port). In an exemplary embodiment the compound exits nozzle 400*a* via compound exit 406*a*. In accordance with an exemplary embodiment of the present invention, nozzle 400*a* may be configured for mixing a compound with a pressurized fluid stream.

In accordance with various embodiments, nozzle 400*a* may be merely a mixing chamber. For example, 400*a* may be configured for mixing a compound with a pressurized fluid stream. This mixing occurs in response to the compound coming into contact with the fluid being carried within the fluid supply. FIG. 4*a* is illustrative of this in that the cavity into which the compound exits, at the compound exit 406*a*, is the same cavity into which the pressurized fluid exits at the second side 402*a*, and thus forms a mixing chamber. The radius/varying cross section 412*a* is beneficial in creating a condition in the system that draws the compound into the mixing chamber. As such, all nozzles may be mixing chambers but all mixing chambers may not be nozzles.

Figure 4B:
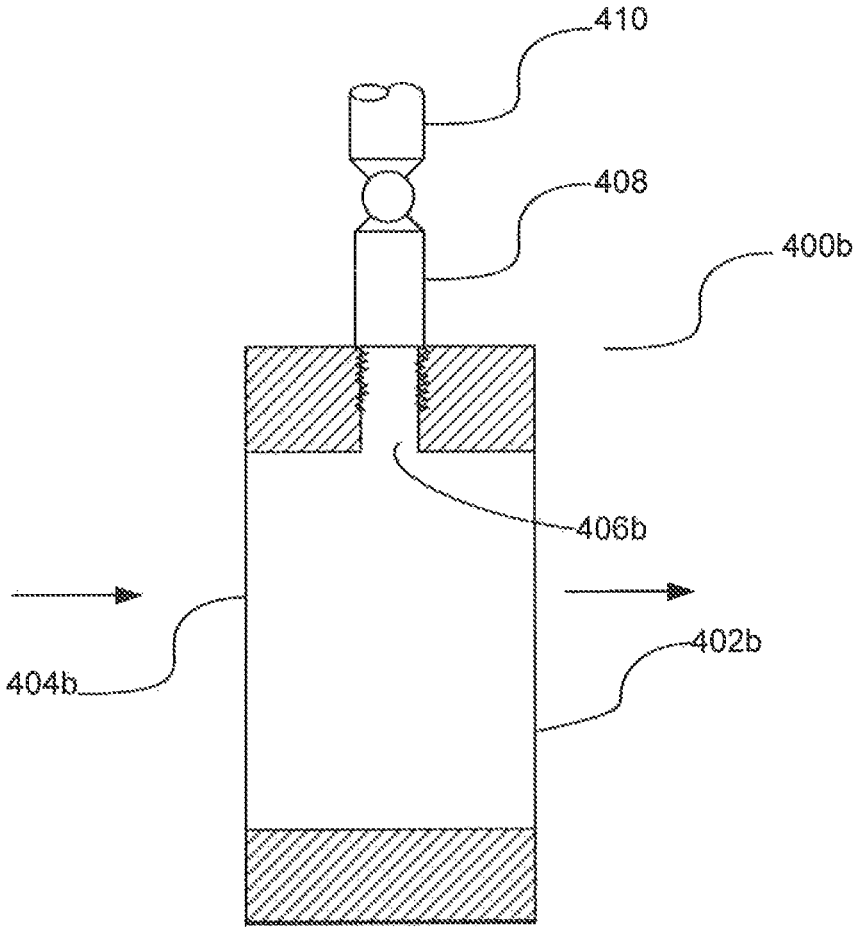
FIG. 4*b* is a cross section of an exemplary embodiment of a mixing chamber used to mix various compounds and pressurized fluid.

In accordance with various embodiments, a mixing chamber may be employed to mix a compound and a pressurized fluid stream. With reference to FIG. 4*b*, mixing chamber 400*b* may have a first side 404*b*, an inlet side to the fluid, and a second side 402*b*, an exit side to the fluid. Mixing chamber 400*b* may be variously sized to accommodate the equipment that it mates to. In one exemplary embodiment mixing chamber 400*b* may be approximately 1-3 inches in diameter at the outlet to accommodate common feed tube sizes used with utility furnaces. However, mixing chamber 400*b* may be sized to fit various components.

The mixing chamber may also have a compound entrance 408. In an exemplary embodiment, the compound may be brought into mixing chamber 400*b* via compound entrance 408. Mixing chamber 400*b* may also have a compound exit 406*b* (also referred to herein as chemical injection port). In an exemplary embodiment the compound exits mixing chamber 400*b* via compound exit 406*b*. In accordance with an exemplary embodiment of the present invention, mixing chamber 400*b* may be configured for mixing a compound with a pressurized fluid stream.

In various embodiments, a mixing chamber may comprise a point where a compound supply line and a fluid supply line intersect. In one example a mixing chamber may be a distinct separate part added to a fluid supply line. For example, mixing chamber 400*b* may be added in-line. In another example, a fluid supply line may be tapped into directly with a second line. Compound may be delivered under pressure through the second line into the fluid supply line. In this embodiment, the mixing chamber may be the point or region of the system where the pressurized fluid and the compound intersect. Any of variety of fluid supply lines on a utility furnace may be accessible for incorporating a mixing chamber, including plant instrument air, service air, primary air into the furnace, secondary air into the furnace, and/or tertiary air into the furnace.

In various embodiments of the present invention, the nozzle may further comprise a valve 410. One exemplary embodiment, valve 410 may be a ball valve. In another exemplary embodiment, valve 410 may be a gate valve. Valve 410 may control the flow of the compound. In accordance with various embodiments of the present invention, the flow of the incoming compound may be stopped and started by opening and closing valve 410. In other exemplary embodiments, valve 410 may prevent the compound from flowing away from nozzle 400*a* and only allow the compound to flow into nozzle 400*a*. For example, valve 410 may be a check valve.

Figure 5A:
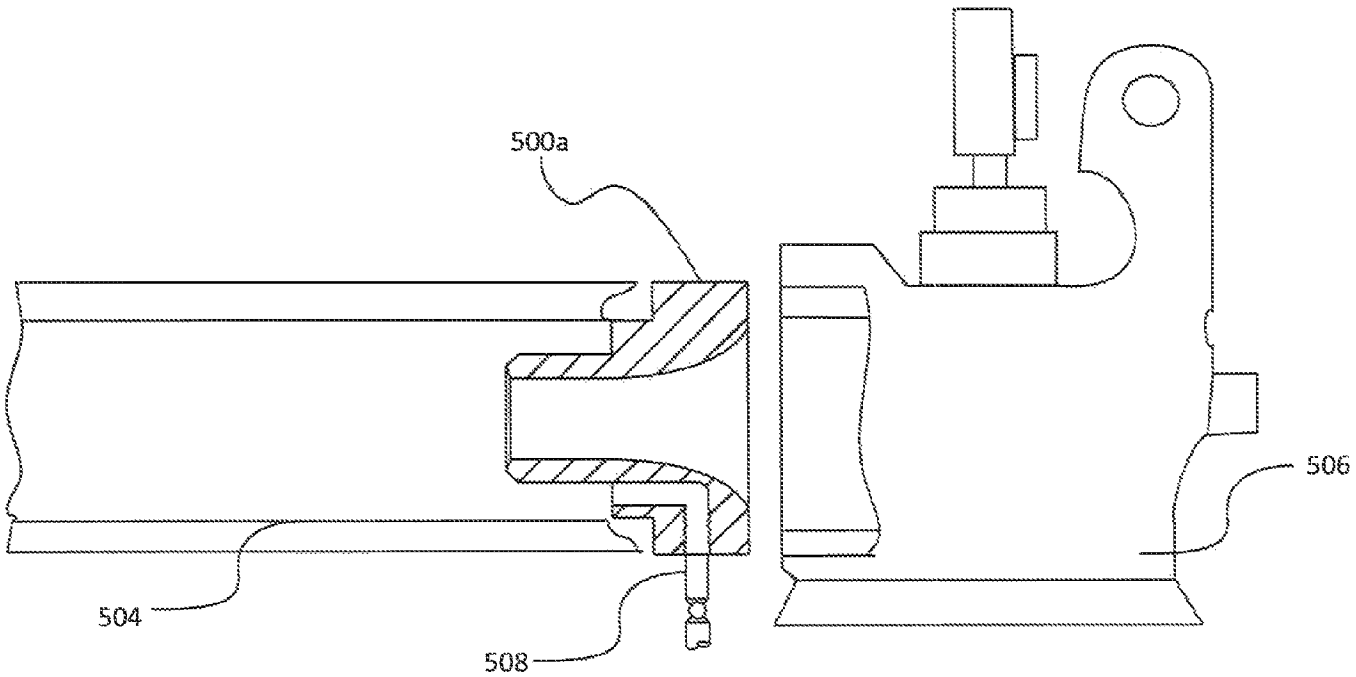
FIG. 5*a* is cross section of an exemplary embodiment of an apparatus for mixing a compound with a pressurized fluid.
Figure 5B:
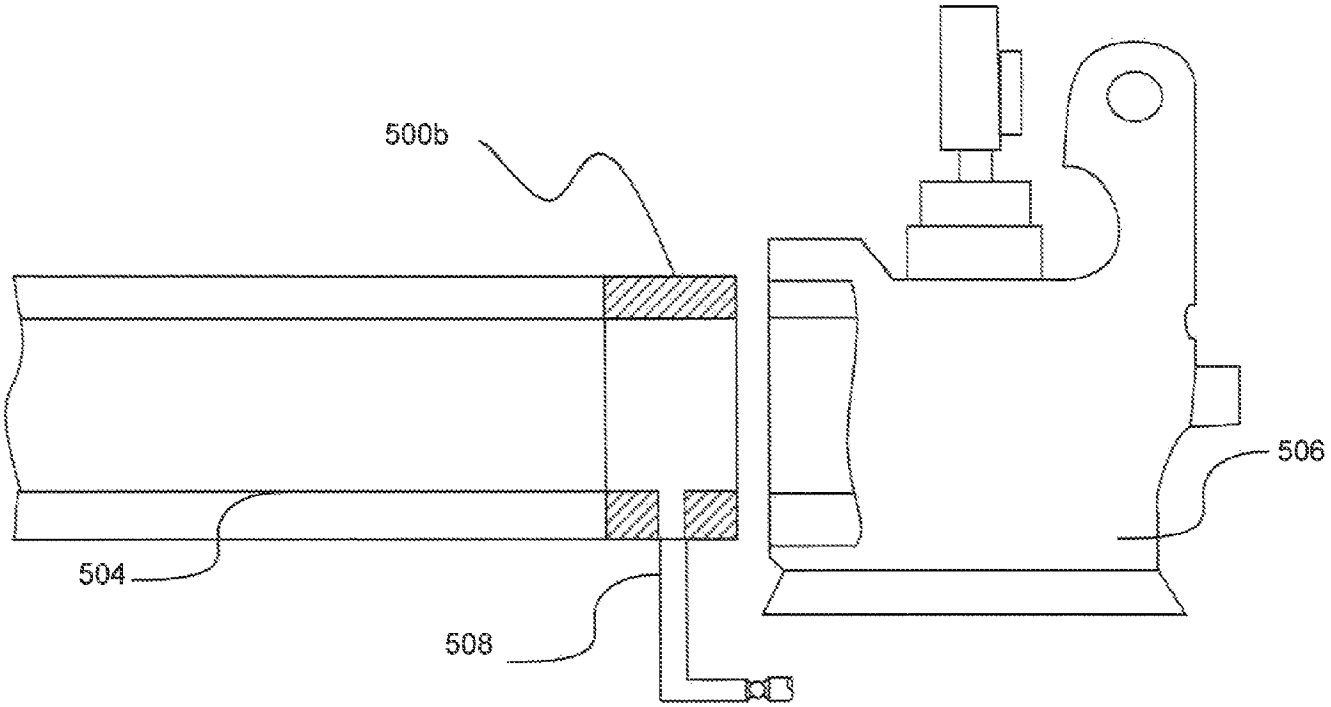
FIG. 5*b* is cross section of an exemplary embodiment of an apparatus for mixing a compound with a pressurized fluid.

In accordance with an exemplary embodiment of the present invention, an apparatus for mixing a compound with a pressurized fluid stream comprises a mixing chamber, a valve, and a feed tube. In this embodiment, referring to FIG. 5*a* and/or FIG. 5*b*, nozzle 500*a* and/or mixing chamber 500*b* may be positioned between valve 506 and feed tube 504. The pressurized fluid can pass through nozzle/mixing chamber 500*a/b* coming from valve 506 and flowing into feed tube 504. Furthermore, nozzle/mixing chamber 500*a/b* may be configured to receive the compound at entrance 508 and mix the compound with the pressurized fluid stream.

In various exemplary embodiments nozzle/mixing chamber 500*a/b* may include features which allow for the connection of nozzle/mixing chamber 500*a/b* to valve 506 or to feed tube 504. Such features might include any of a variety of fasteners known in the industry e.g. bolts, weld, pressure fittings, bracketed flanges, etc. In other various embodiments nozzle/mixing chamber 500*a/b* may be an integral or integrated part of valve 506 or feed tube 504. For example, nozzle/mixing chamber 500*a/b* and feed tube 504 may be manufactured as one piece. In an alternate example valve 506 and nozzle/mixing chamber 500*a/b* may be manufactured as one piece. Likewise, all three elements may be manufactured as one piece.

In one exemplary embodiment, valve 506 is a poppet valve. In other embodiments valve 506 is any of a variety of valves include but not limited to diaphragm valves, pressure regulator valves, check valves, etc. In various embodiments of the present invention valve 506 can be any of a variety of valves used in the art whereby the valve controls the flow of fluid. Furthermore, valve 506 may be configured to adjust the pressure of the fluid passing through.

As discussed above, the apparatus may further comprise feed tube 504. In various embodiments of the present invention, feed tube 504 may be configured to attach directly to either valve 506 or nozzle/mixing chamber 500*a/b*. In an exemplary embodiment feed tube 504 may be configured to be detached from valve 506 and attached to nozzle/mixing chamber 500*a* or 500*b* inserted between feed tube 504 and valve 506. In this manner, an existing device may be retrofitted to include the nozzle/mixing chamber 500*a/b*. As discussed above the feed tube may also be integrated with nozzle/mixing chamber 500*a/b* and/or valve 506. In various embodiments, feed tube 504 may be configured to withstand the pressure and corrosion caused by any material flowing through it. In various examples, fluid may flow through the feed tube at 300 SCFM to 1000 SCFM. However, depending on the application smaller or larger rates may be used. The feed tube may be comprised of hardened steel that is capable of withstanding the mixture of the high pressure fluid and also the compound introduced at nozzle/mixing chamber 500*a/b*. Further, other various materials may be used depending on the intended use of the system. In some instances the feed tube may be a component already installed in a facility incorporating the apparatus.

In one exemplary embodiment of the present invention, the compound introduced at nozzle/mixing chamber 500*a/b* may be any of a variety of solids, liquids, or gases that may beneficially be injected into a utility furnace. Furthermore, the compounds should be configured such that they are capable of being transported in line through a pressure system. In various examples the compound may be caused to move through the system via a positive pressure or a negative pressure.

In accordance with an exemplary embodiment, a compound in solid form may be sufficiently granular that it can pass through various types of tubing. In one exemplary embodiment, the compound may be a solid agent or a dry compound, being a substantially dry, granular solid having insignificant levels of humidity or liquid. In various exemplary embodiments, the compound is delivered as a slurry, liquid, or gas. For example, delivering the compound as a slurry, liquid, or gas may be beneficial where pumping is incorporated. This may be especially true where there are high pressures to overcome at the nozzle. In another example, delivering the compound as a solid may be beneficial when the compound is delivered by transport air created by a vacuum. Various examples of compounds used in the system may include, but are not limited to, magnesium hydroxide, potassium hydroxide, sodium hydroxide, aluminum hydroxide, magnesium, kaolin, mullite, trona, sodium bromide, potassium bromide, magnesium carbonate, magnesite, micronized limestone, and/or urea-based solids delivered dry or wet. Any such compound that may be desirable for a variety of chemically reactive, cleaning, processing or other beneficial purposes inside of a utility furnace may also be incorporated.

In one exemplary embodiment of the present invention, the fluid comprises pressurized air. In other various embodiments the fluid might comprise steam. Moreover, the fluid may comprise any compressed or pressurized fluid capable of being injected into the system.

Figure 3:
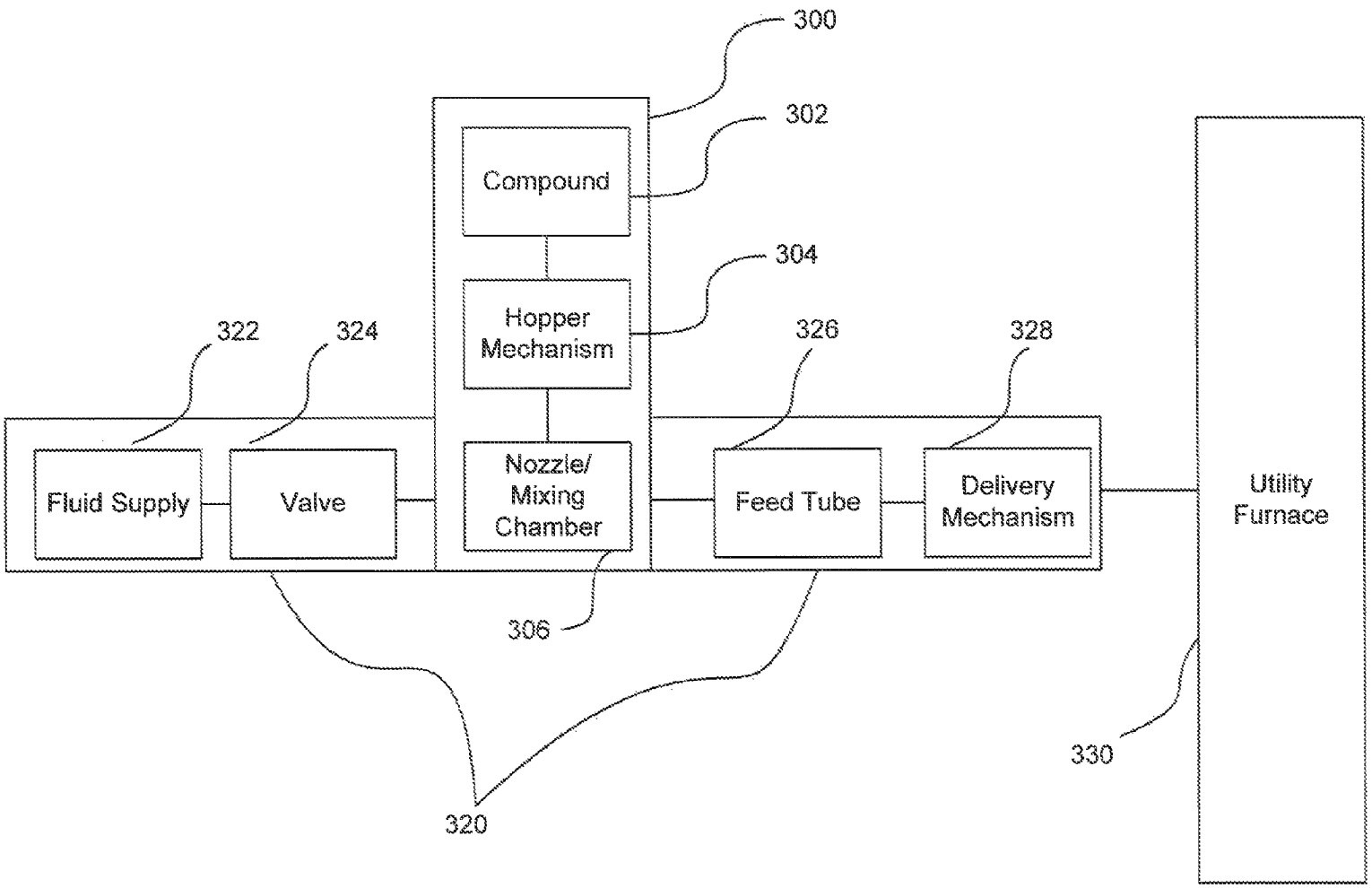
FIG. 3 is an exemplary embodiment of a flow process of a system for injecting compound into a utility furnace.

In accordance with an exemplary embodiment of the present invention, the apparatus for mixing a compound with a pressurized fluid stream (comprising a nozzle, a valve, and a feed tube) may be used or adapted to a utility furnace. In an exemplary embodiment, and with reference to FIG. 3, the apparatus may also be incorporated into a larger system wherein the system comprises compound feed mechanism 300 which comprises compound 302, compound storage 304, and mixing chamber 306, coupled inline with fluid delivery system 320 which comprises fluid supply 322, valve 324, feed tube 326 and delivery mechanism 328 either removably or permanently coupled to utility furnace 330.

The fluid, as contemplated in an exemplary embodiment of the system, may comprise any of a steam, air or other compressed gasses or fluids typically released in a utility furnace. In accordance with an exemplary embodiment the fluid supply may be an air compressor, steam recirculation system, pump, pressure vessel etc. Furthermore, the fluid supply may be any commercially available mechanism capable of creating, maintaining, or adjusting these pressures as contemplated herein. The fluid supply may be positioned and/or coupled to valve 324 directly or by means of other connections and/or devices.

Figure 7:
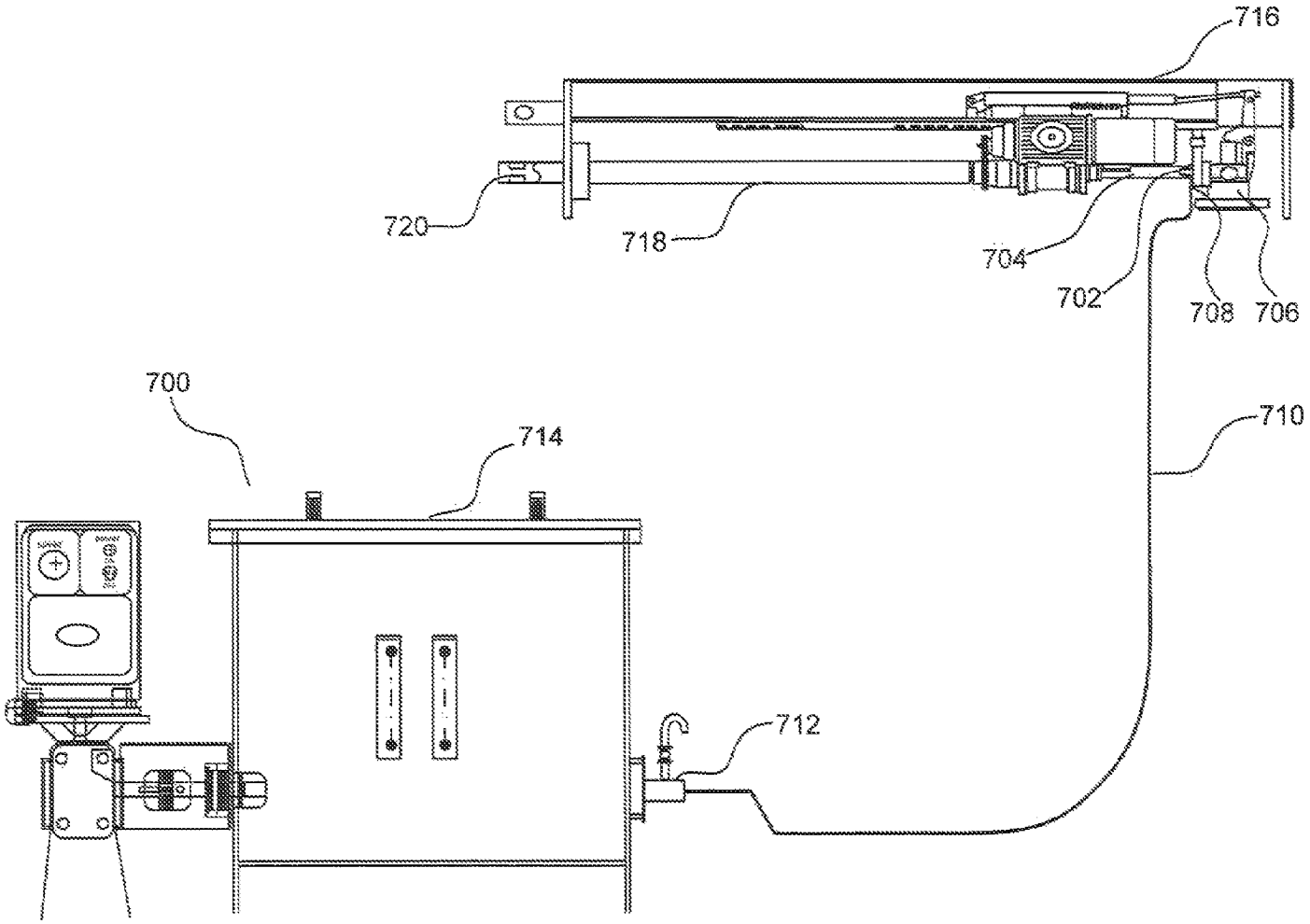
FIG. 7 is an exemplary embodiment of distribution of a compound from a retractable sootblower.

In accordance with an exemplary embodiment of the present invention, referring to FIG. 7, the delivery mechanism may be lance 718 and/or injection nozzle 720. In another exemplary embodiment, the delivery mechanism comprises the injection nozzle associated with a wall blower. In various exemplary embodiments, the delivery mechanism may be any permanent or temporary fixture on the utility furnace. In various exemplary embodiments of the present invention, a delivery mechanism is any component capable of delivering the pressurized fluid and/or fluid mixed with compound into a utility furnace.

Figure 2A:
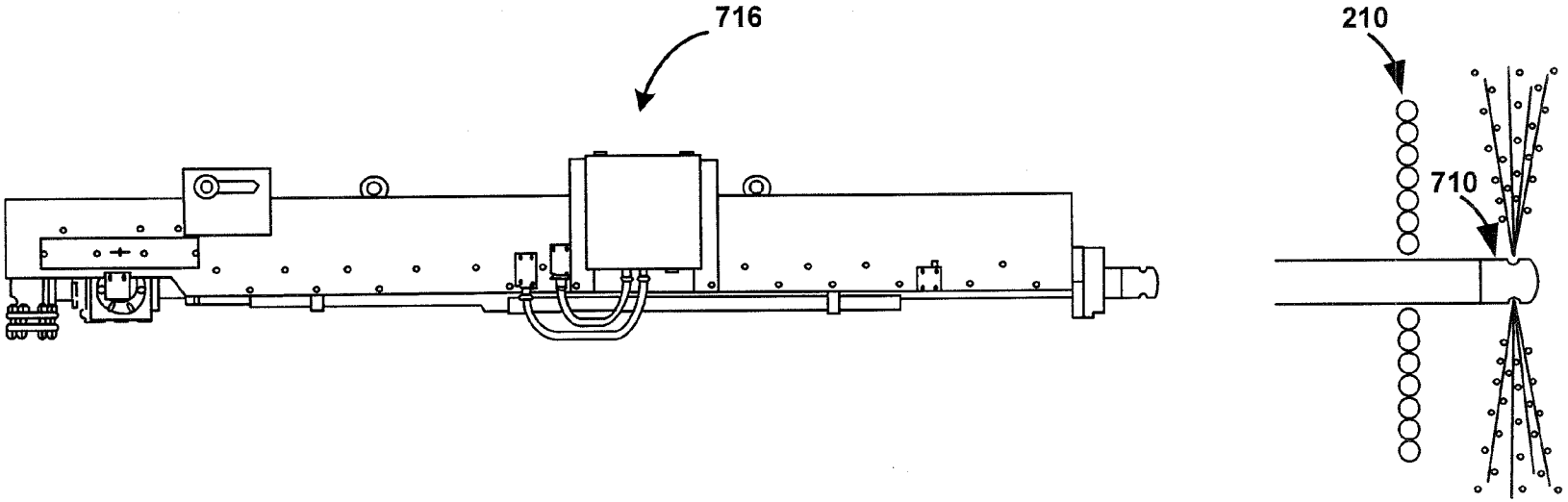
FIG. 2*a* is an exemplary long retractable sootblower and an example of distribution from the long retractable sootblower.
Figure 2B:
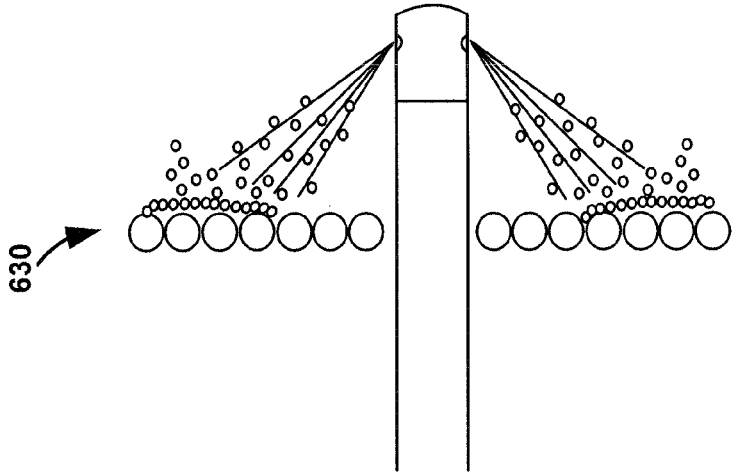
FIG. 2*b* is an exemplary retractable wall mounted sootblower and an example of distribution from the retractable wall mounted sootblower.
Figure 2B:
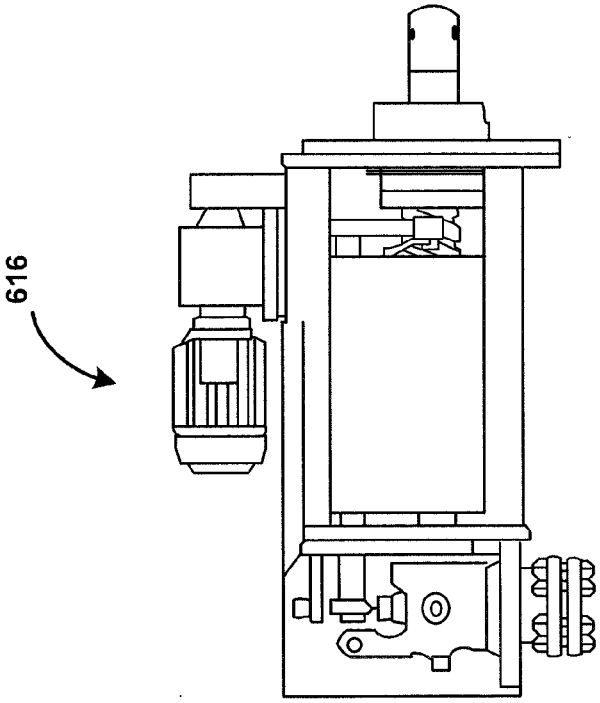
Figure 2C:
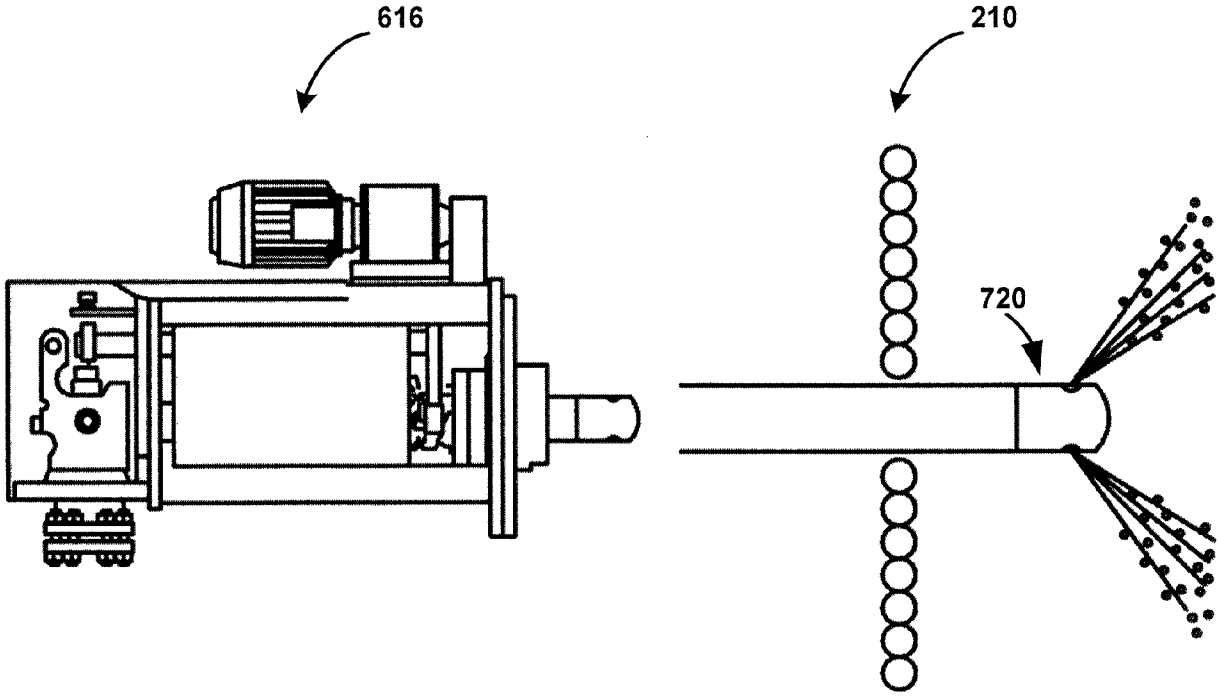
FIG. 2*c* is an exemplary retractable wall mounted sootblower and an example of distribution (with the nozzle oriented to blow away from the wall) from the retractable wall mounted sootblower.
Figure 2D:
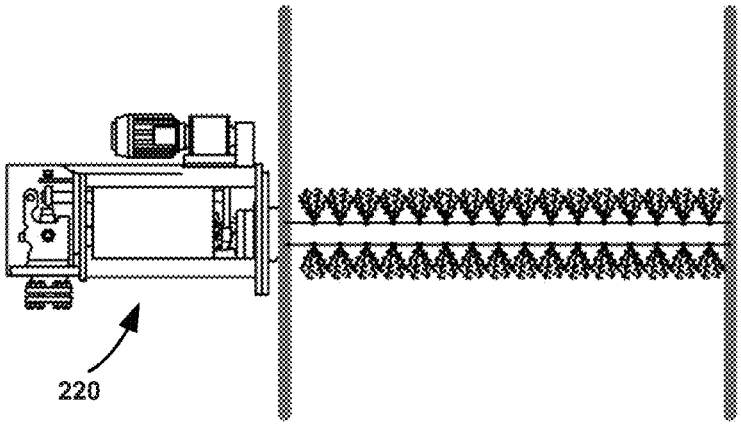
FIG. 2*d* is an exemplary rotating element sootblower and an example of distribution from the rotating element sootblower.

In one exemplary embodiment, lance 718 may be capable of being inserted partially or fully into a utility furnace. The lance tube is what is carried and rotated into the furnace by a gearbox/motor attached to the sootblower. The lance tube may surround the stationary feed tube and is sealed by a gland. In another exemplary embodiment, injection nozzle 720 is configured to deliver the fluid supply and/or the fluid supply compound mixture to specific locations inside the utility furnace, such as to a wall as depicted in FIG. 2*b* or out into an open chamber as depicted in FIGS. 2*a*, 2*c*, 2*d* and 2*e*. Thus, the compound can be delivered to the exhaust gas, exhaust chamber, combustion chamber, pre-combustion (e.g., burner), water walls 210, pipes, superheat tubes, the back pass, or any other element in a utility furnace or its exhaust gas stream.

With reference to the compound, as discussed above, the compound may be received by the nozzle. This compound may be stored in any of a variety devices connected to the nozzle. In accordance with an exemplary embodiment, and with reference to FIG. 6, a compound storage device 614 may comprise a hopper with an auger feeder connected either directly or indirectly to nozzle 602. In one example, the compound is stored in a nonpressurized hopper. In one example, the hopper may store a wet compound. In another example, the hopper may store a dry compound. In accordance with various other exemplary embodiments, compound storage device 614 may comprise a storage container and pressure mechanism. In such an embodiment, the compound may be stored and delivered by the pressure mechanism which may include pressurized vessels, gravity feed, pumps (including any of a variety of direct lift, positive displacement, velocity, buoyancy, centrifugal and/or gravity pumps), conveyors or any commonly known apparatus capable of delivering the compound to the inlet of the nozzle. For example, the pressure mechanism may comprise positive displacement pump 618. Pump 618 may be located with storage device 614. Pump 618 may also be located along delivery line 610, providing pressure to nozzle and or mixing chamber 602. Pump 618 may delivery a wet compound to nozzle and or mixing chamber 602.

Various quantities of this compound may be incorporated in the use and functionality of the system herein discussed. In one exemplary embodiment, upwards of 1000 lbs of compound per cleaning cycle may be injected into a utility furnace for the removal of soot. However, the quantities can vary depending on the size of the utility furnace and purpose for which the compound is being injected.

While the compound can be delivered and/or received by the mixing chamber/nozzle in a variety of ways as discussed previously, the motivation of compound through the mixing chamber/nozzle can also occur in a variety of ways. In accordance with an exemplary embodiment of the present invention, a vacuum may be present on the second side of nozzle 400*a* which may create a force which may draw sufficient amounts of compound into the fluid stream to be delivered with the system. In one exemplary embodiment, nozzle 400*a* may cause 60 inches of vacuum (i.e. a drop in pressure expressed in inches of water). In various other embodiments the vacuum can be greater or less than 60 inches of water depending on the application. For example, there can be no vacuum at nozzle 400*a* but instead nozzle 400*a* may create a zone of static or low pressure compared to the fluids in the sootblower. Variations on the profile of the nozzle can be optimized to produce a sufficient vacuum and/or a maximum pressure drop. In other various embodiments, the compound may be pressurized by a pump or the like and introduced into the fluid stream under pressure. Such pressurization can occur in any way typical of the art including, but not limited to the threes created by the devices discussed above.

Referring again to FIG. 3, and in an exemplary embodiment, fluid delivery mechanism 320 as discussed above can be configured to deliver a pressurized fluid flow into utility furnace 330. In one exemplary embodiment, the utility furnace is a coal fired induction draft power plant furnace. Moreover, a utility furnace may be any of a commercially available or custom furnaces including but not limited to boilers, HVAC, cokers, pulp and paper furnaces, etc. In an exemplary embodiment the furnace may be any of a variety of boilers fired by a variety of fossil fuels including, but not limited to, coal, petroleum, natural gas, etc. In other various embodiments of the present invention, a utility furnace might include any of a variety of boilers fired by alternative fuels, such as, for example, bio fuels or a combination of bio fuels and fossil fuels. In various exemplary embodiments of the present invention, utility furnace 320 may comprise furnaces used in a variety of industries including metal refineries, (e.g. cokers), pulp and paper, energy production, waste disposal, heating, etc.

Figure 1:
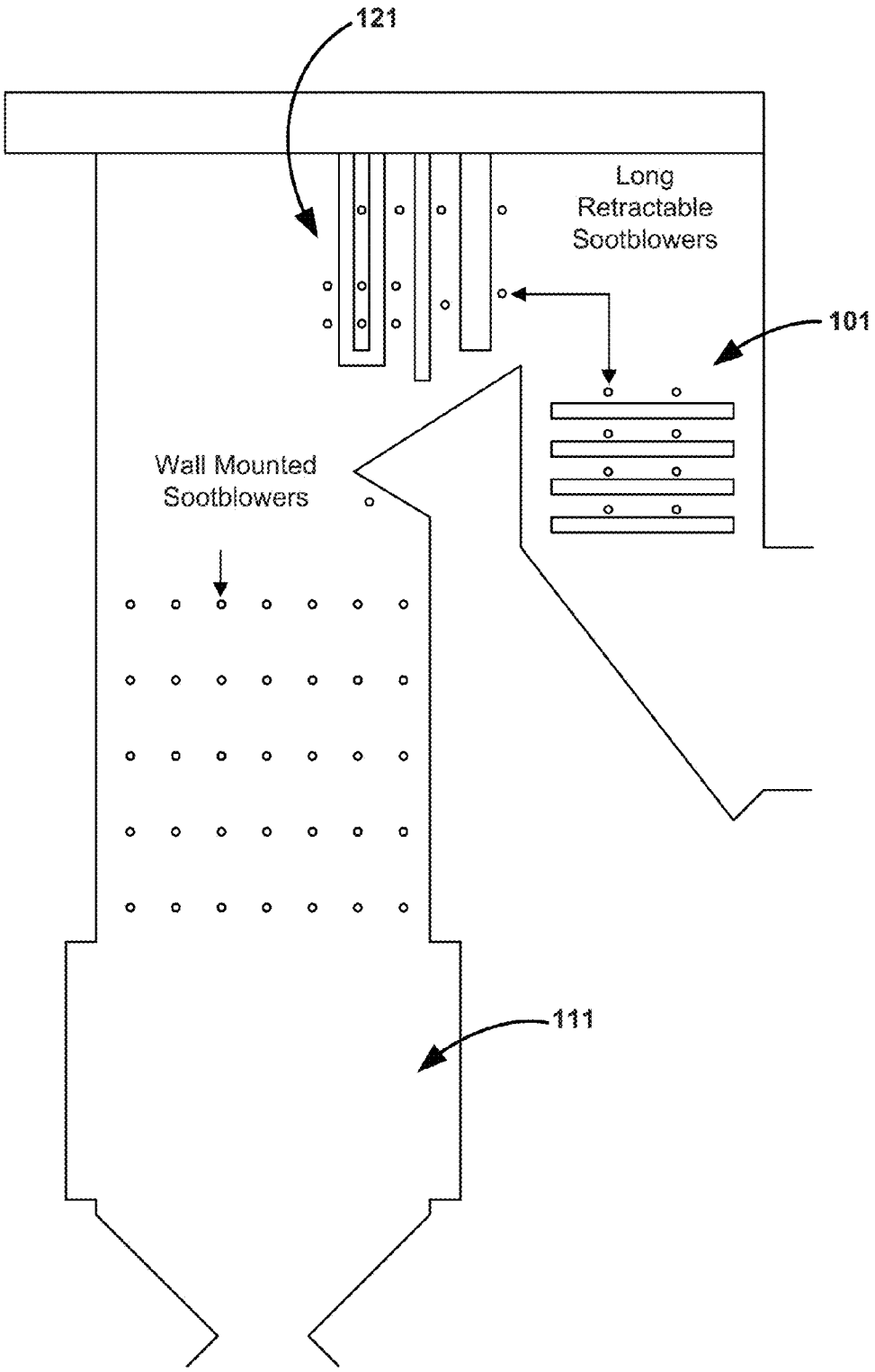
FIG. 1 is an exemplary utility furnace depicting sootblower locations.

Referring to FIG. 1, soot blowers can be located in numerous locations around a furnace. Variations in numbers and locations depend on the size and type of furnaces. Each location may be specifically targeted to allow access to particular elements or locations inside of the furnace. In an exemplary embodiment, these strategically located sootblowers can be used to deliver compound into the furnace. For example, wall mounted soot blowers may be located in the primary combustion area of the furnace. Also, retractable long lance type sootblowers may be located in the superheater 121 or back pass 101 portions of the furnace. In accordance with various other exemplary embodiments, a utility furnace may have various types of sootblowers located near superheaters, reheaters, convection section of horizontal tubes, the economizer and/or air preheaters. Furthermore, in various embodiments, compound injection may be used via pressurized fluid stream at any sootblower location.

Figure 6:
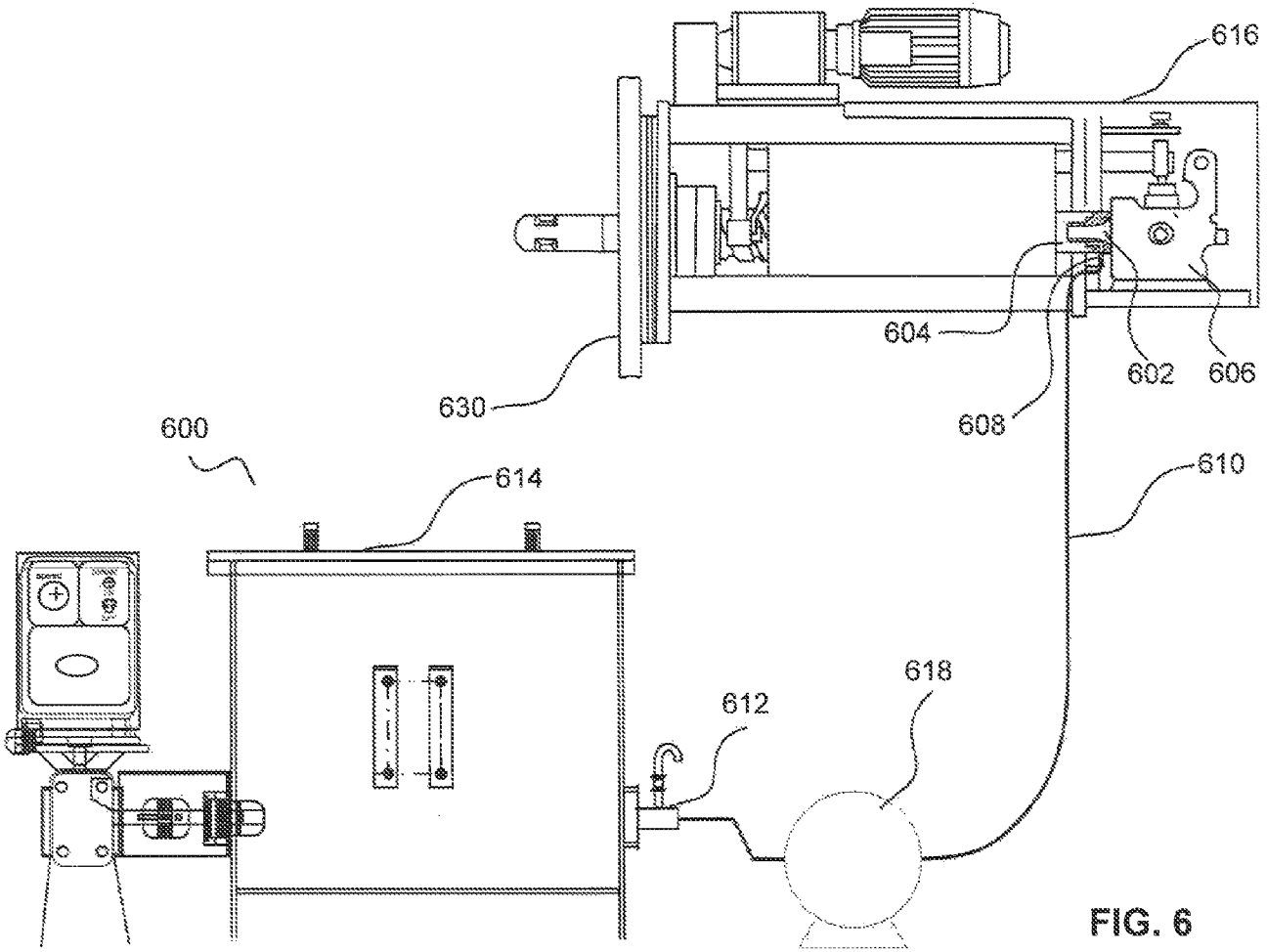
FIG. 6 is an exemplary embodiment of distribution of a compound from a wall mounted sootblower.

In an exemplary embodiment of the present invention, and with reference to FIG. 6, a coal fired furnace system may comprise a retractable wall mounted soot blowers 616. Wall mounted soot blower 616 may, for example be a Diamond Power Model IR-3Z sootblower or a Clyde Bergemann Model RW5E. Furthermore, wall mounted soot blower 616 may comprise any device configured to deliver fluid to the interior walls of a utility furnace.

In an exemplary embodiment, wall mounted soot blower 616 may comprise feed tube 604 and valve 606. In one exemplary embodiment nozzle 602 is inserted between feed tube 604 and valve 606. For example nozzle 602 may be retrofitted into wall mounted soot blower 616. In another example, wall mounted soot blower 616 may be originally constructed with nozzle 602 between feed tube 604 and valve 606. In various exemplary embodiments, nozzle 602 may be a component of a compound feed mechanism 600 which comprises valve 608, feed line 610, transport air valve 612 and compound storage 614. Valve 608 may be coupled to feed line 610. Feed line 610 may be coupled to transport air valve 612. Transport air valve 612 may be coupled to compound storage 614.

In an exemplary embodiment, nozzle 602 may receive the compound from compound storage 614 and mix the compound with fluid flowing through wall mounted sootblower 616. Wall mounted sootblower 616 may carry the compound to any of a variety of utility furnaces. Wall mounted sootblower 616 may also deliver the compound to wall 630 or any targeted area of the furnace reachable by wall mounted sootblower 616.

In various other embodiments, transport air valve 612 may also include components capable of attaching pressurized air to feed line 610. For example, transport air valve 612 may also include a flow regulator, an air pressure regulator, and/or a filter. These components may enable transport air valve 612 to function as an air pressure source so that it is possible to add additional transport air to move larger heavier quantities of the compound.

In an exemplary embodiment of the present invention, and with reference to FIG. 7, retractable sootblower 716 may comprise feed tube 704 and valve 706. In one exemplary embodiment nozzle 702 is inserted between feed tube 704 and valve 706. For example nozzle 702 may be retrofitted into retractable sootblower 716. In another example, retractable sootblower 716 may be originally constructed with nozzle 702 between feed tube 704 and valve 706. In various exemplary embodiments, nozzle 702 may be a component of a compound feed mechanism 700 which comprises valve 708, feed line 710, transport air valve 712 and compound storage 714. Valve 708 may be coupled to feed line 710. Feed line 710 may be coupled to transport air valve 712. Transport air valve 712 may be coupled to compound storage 714.

In an exemplary embodiment nozzle, 702 may receive the compound from compound storage 714 and mix the compound with fluid flowing through retractable sootblower 716. In various examples, the sootblower may be a Long Retract Diamond Power Model IK-525 or a Long Retract Clyde Bergemann Model US. Sootblower 716 may comprise any device configured to deliver fluid into the interior of any of a variety of utility furnaces. Specifically, lance 718 and injection nozzle 720 may extend into the interior of a utility furnace. Retractable sootblower 716 may then deliver the compound to, for example, the wall, superheat pipes, or any targeted area of the furnace reachable by retractable sootblower 716.

Figure 2E:
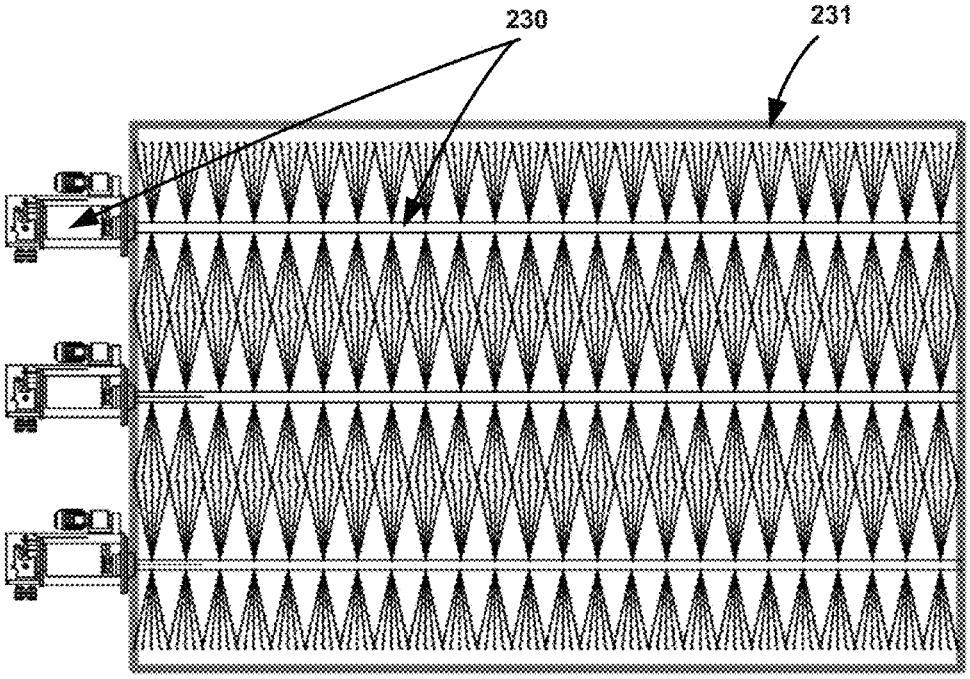
FIG. 2*e* is an exemplary array of sootblowers spanning the exhaust gas stream and an example of distribution from the array of sootblowers.

In various exemplary embodiments of the present invention, the nozzle can be placed in line with any commercially available or custom built soot blower including but not limited to a retractable wall sootblower 616, long retractable sootblower 716, rotating element sootblower 220, helical sootblower, and rake-type blower. FIG. 2*e* illustrates an array of rotating element sootblowers 230 spanning the exhaust gas stream and providing effective coverage over the entire cross-section of a duct 231. The nozzle may be included as a constituent piece of the valve, the feed tube, or a combination of either. Furthermore, the sootblowers may be installed on a furnace before adding the nozzle and compound feed. Alternatively a sootblower can be installed on a furnace after it has been retrofitted with a nozzle.

In accordance with various exemplary embodiments, an apparatus mixes a compound with a pressurized fluid to be delivered into a utility furnace. The mixture of the compound and the pressurized fluid may occur inside the body of the nozzle or may occur as the nozzle delivers the compound and pressurized fluid to the feed tube. The nozzle functions to mix the compound with the pressurized fluid stream. This mixture of pressurized fluid and compound is then delivered into a furnace, either by means of a custom apparatus or commercial apparatus. Any apparatus that functionally delivers the fluid compound mixture to the furnace is contemplated herein.

For convenience a number of pressures and relative pressures may be discussed herein. For example, a first pressure may be the pressure at the poppet valve. This pressure is what is being put through the sootblower in the absence of the present invention. This pressure may also vary greatly due to a number of factors such as plant system pressure, poppet valve setting, and/or sootblower type. A second pressure may be the pressure at the chemical injection port. The second pressure is a function of the pressure drop across the nozzle. A third pressure discussed may be the pressure required to push the compound into the fluid stream running through the sootblower. The third pressure may be formed on or behind the compound in order to deliver it to the sootblower. The third pressure may be created by a pump. In instances where there is a sufficient vacuum at the chemical injection port or the second pressure, there may not need to be a third pressure to deliver compound. The pressures discussed herein are relative to atmospheric pressures. In various examples, functionality of the system with various commercially manufactured sootblowers was tested as shown in table 1.

TABLE 1

| Sootblower Manufacturer | Medium | Pressure at Poppet Valve | Pressure at Chemical Injection Port | Displacement Pump Pressure |
|---|---|---|---|---|
| Copes Vulcan T-40 | Steam | 390 PSI | 38 PSI | 60 PSI |
| Clyde Bergmann US Blower | Steam | 230 PSI | 5 PSI | 20 PSI |
| Diamond Power IK-525 Blower | Air | 165 PSI | −2.5 PSI | 10 PSI |

In various examples, such as the test performed on the Copes Vulcan T-40 (see Table 1), the pressure of the fluid at the poppet valve in a utility furnace may be maximized in an attempt to deal with extreme slagging. In some instances the fluid pressures at the poppet valves may be operated at higher pressures than the utility furnace manufacture recommended pressure settings. High poppet valve pressures may translate into high chemical injection port pressures. In such instances, a pump may be used to increase the compound pressure in order to overcome the pressure at the chemical injection port. Furthermore, depending on the situation and/or the type of mechanism used to overcome the chemical injection port pressures, the compound may be introduced as a wet slurry in order to ease introduction into the pressurized stream.

In other examples, such as the test performed on the Clyde Bergmann US Blower (see Table 1), lower fluid pressures at the poppet valve correspond to lower fluid pressures at the chemical injection port. In such instances, lower pressures from the pump may be used in order to overcome the pressure at the chemical injection port. Again, the compound may be introduced as a wet slurry in order to ease introduction into the pressurized stream.

In still other examples, such as the test performed on the Diamond Power IK-525 Blower (see Table 1), the still lower pressures at the poppet valve illustrate the vacuum that may be created at the nozzle allowing substantially easier introduction of the compound into the furnace regardless whether it is slurried or in dry form.

While the pressures at the poppet valve of the various sootblowers in the industry may vary greatly depending on the type and condition of the sootblowers or the conditions of the medium, utility furnace, or other factors, it should be noted that the systems, devices, and methods discussed herein are beneficial in adapting the sootblowers to receive and disperse various compounds in the utility furnace regardless of the countless variations.

In accordance with various aspects of the invention, as discussed above, the delivery mechanism may be any permanent or temporary fixture on the utility furnace. In various exemplary embodiments of the present invention, a delivery mechanism is any component capable of delivering the pressurized fluid and/or mix of compound and fluid into a utility furnace.

As may be typical of a burner in a utility furnace, the burner can be vertical or horizontal, having air blowers located around the burner. On the outlet of the air blower are devices with movable flaps or vanes that control the shape and pattern of the flame from the burner. These air blowers can be classified as primary secondary and tertiary depending on when the air is introduced into the furnace. Primary air is the first air introduced into the furnace. Primary air is the first combustion air added to fuel being carried into the burner. Secondary air is used to supplement and finely tune the primary air. Compound may be injected into the furnace by supplying compound via plant utility air to the burner front. Then by routing high temperature tubing (or similar material) from the burner front, outside the furnace, to the internal combustion air delivered by the air blower devices.

Figure 8B:
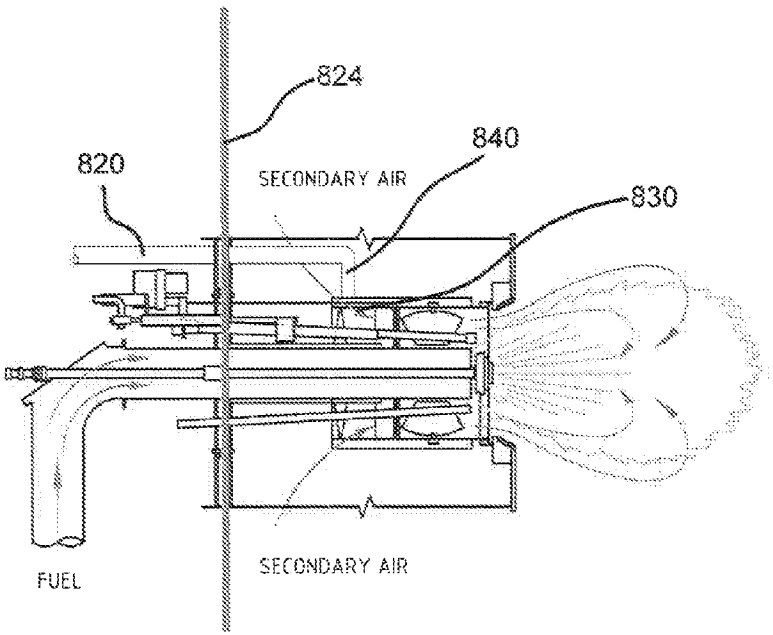
FIG. 8*b* is an exemplary embodiment of a burner receiving compound through secondary air.
Figure 8A:
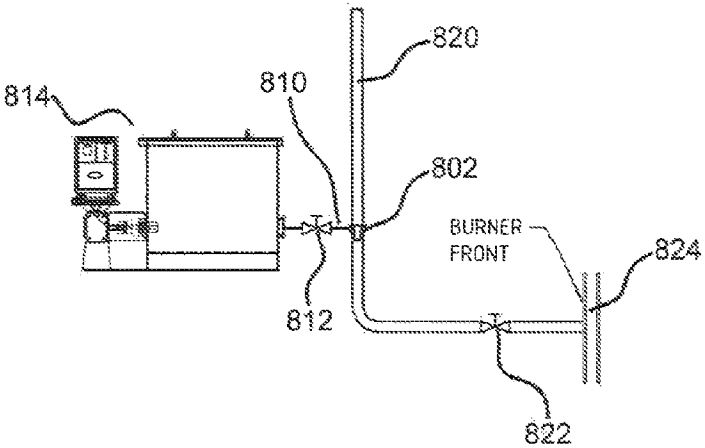
FIG. 8*a* is an exemplary embodiment of a system delivering compound into air to a burner.

In accordance with various embodiments, as illustrated in FIGS. 8*a* and 8*b*, the compound may be delivered into the utility furnace through the burner. For example, the compound may be delivered to the primary air at or near the burner and introduced into the furnace with the primary air. Primary air provides the initial ignition oxygen for mixture with the fuel and subsequent combustion. In another example, the compound may be delivered to the secondary air at or near the burner and introduced into the furnace with the secondary air. Secondary air is additional carefully controlled air flow that allows the higher hydrocarbons to burn (e.g. trim air.) In another example, the compound may be delivered with tertiary air. Tertiary air insures delayed combustion purposely for NOx combustion (e.g. super trim air used on low NOx burners.) In various examples, the compound may be delivered to the furnace interior at the burners through any air transport or openings available.

In accordance with various embodiments, a mixing chamber 802 may be located in the fluid supply 820. As may be typical of a utility furnace, the fluid supply 820, which may be instrument air and/or plant utility air, may be routed to the burner front. The compound may be delivered from the compound delivery device 814 through delivery tube 810 and valve 812 to the mixing chamber 802. In the mixing chamber the compound may be mixed with the plant utility air under pressure. The mixture of the compound and the pressurized fluid may then travel through the fluid supply 820 to the burner front 824. Fluid supply line 820 may have a valve 822 to shut off compound delivery and/or regulate supply air to the burner. From the burner front 824, high temperature line 840 may be routed to the air blowers 830 in the burner. As the high temperature line 840 between the burner front 824 and the air blowers 830 is likely not present on a commercial burner, the high temperature line 840 may need to be routed in the field on the burner. In one example, high temperature line 840 may deliver compound to the primary air. In one example, high temperature line 840 may deliver compound to the secondary air. In one example, high temperature line 840 may deliver compound to the tertiary air. In on example, high temperature line 840 may deliver compound to one or more of the primary, secondary, or tertiary air. The air from the air blowers carrying the compound exits the burner into the utility furnace to be combusted in the "fire portion" 111.

The compound when introduced into the utility furnace adds a benefit over the already available pressurized fluid. In one exemplary embodiment, $MgHO_2$ is the compound. In this example, $MgHO_2$ may be delivered by sootblowers to slag coated steam/water pipes to aid in the removal of slag. In this example, the $MgHO_2$ is suited specifically to breaking up a variety of slag accumulations caused by coal based fuels burned inside of the utility furnace.

In another exemplary embodiment, magnesium is added into a utility furnace to aid in the encapsulation of harmful by products. In other exemplary embodiments, magnesium, kaolin, mullite, and/or other beneficial agents or combinations of these agents can be introduced into the utility furnace. These agents can be introduced into the utility furnace, superheats, back pass, preheats, exhaust stream, or other location to aid in the encapsulation of $SO_2$.

In another exemplary embodiment, multiple compounds can be injected into the sootblowers to deal with inclement conditions such as low temperature. Dry has its advantages in extreme cold temperatures in the sootblower in the furnace; dry injection is a good option for injecting in the ducts and the discharge of the air-preheaters. However due to difficulties in delivering dry compound at higher pressures, poly-ethylene glycol (PEG) mixed with other chemicals discussed above, for example, $MgHO_2$, may be a good combination as an alternative to dry injection in extreme low temperature conditions. In accordance with one embodiment, the PEG can be effectively mixed with the compound at 55-60% solids by weight. Furthermore, the PEG is EPA compliant to inject in the furnace. In various other embodiments, the mixture of PEG and compound can be effective for dusting when transporting coal. Thus this combination functions as a dust inhibitor and slag suppressor.

Figure 9:
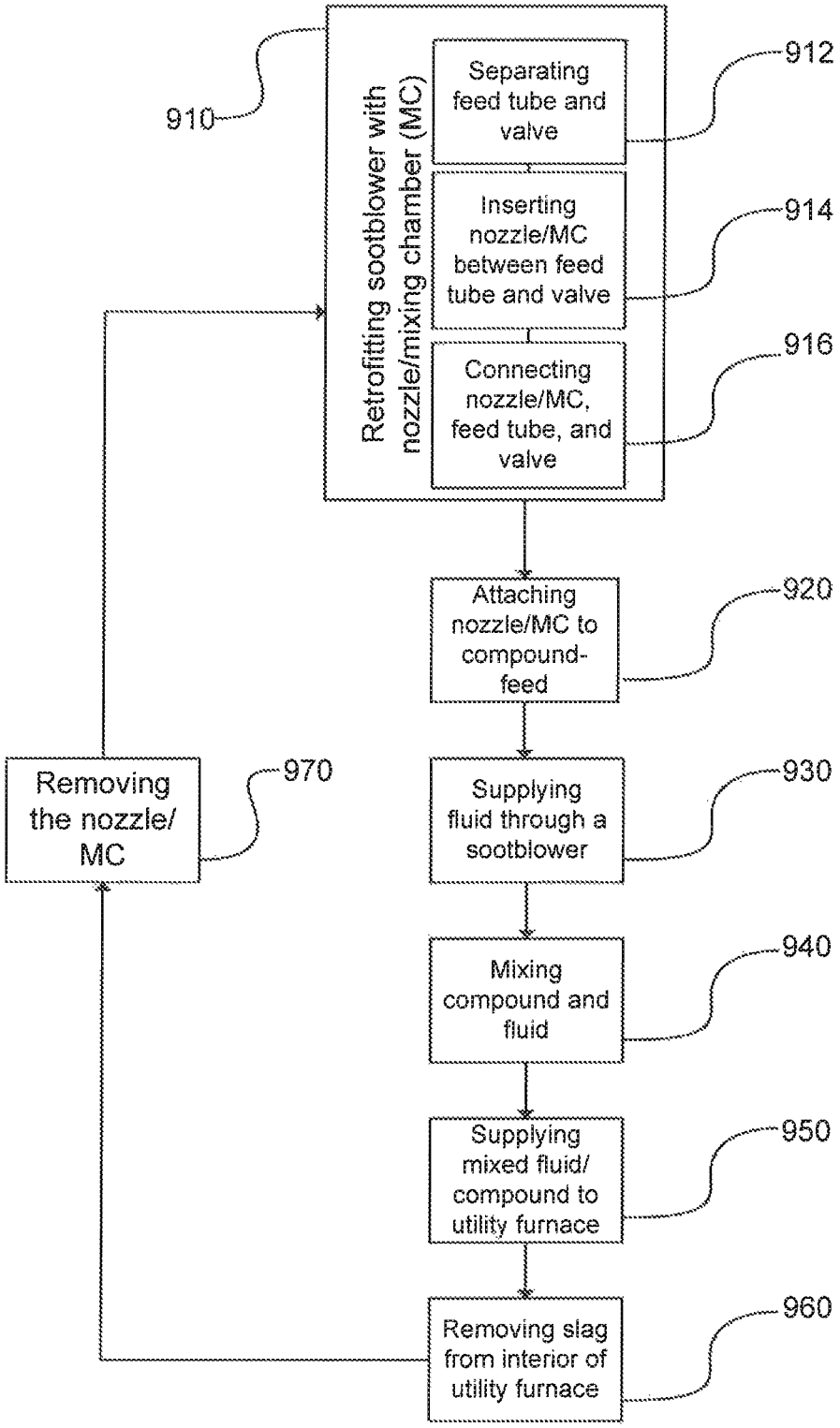
FIG. 9 is an exemplary embodiment of a method of the present invention.

In accordance with an exemplary embodiment and with reference to FIG. 9, a method is provided for introducing a solid compound into a furnace. The method comprises retrofitting a sootblower with a nozzle, such as nozzle 400*a* in FIG. 4*a* (step 910). Attaching the nozzle to a compound feed and receiving a compound into the nozzle (step 920). Supplying a fluid through a sootblower (step 930). Mixing the compound with the fluid (step 940). Transporting the compound and fluid through a feed tube into a utility furnace (step 950). Various exemplary embodiments may further comprise, reacting the compound in the utility furnace (step 960). Furthermore, in one exemplary embodiment, the method includes removing the nozzle (which was installed in step 910) from the system (step 970).

In accordance with an exemplary embodiment, a user may retrofit the nozzle by installing it on an operational sootblower in use on any utility furnace (step 910). For example, the user may separate the poppet valve and feed tube in a sootblower (step 912) and insert a nozzle by removably connecting the nozzle between the valve and the feed tube (step 914). When separating the valve and the feed tube the fastening mechanism is removed. For example, in some commercially used sootblowers this mechanism is a 600 pound flange with four ½ in NPT studs. In accordance with various embodiments the user may need to replace the studs that originally held the feed tube and the poppet valve together. The new studs may need to be longer in order to make up the new distance added by the nozzle. For example when placing a nozzle inline with some commercial feed tubes and valves, 2 inch longer studs may be used. The user may reconnect the valve and the feed tube with the nozzle in between (step 916).

In accordance with and exemplary embodiment, the user may attach the nozzle to a compound feed mechanism (step 920). As discussed above the compound feed mechanism may deliver compound to the nozzle in a number of ways. In accordance with one embodiment of the present invention, the compound is drawn into the nozzle by a vacuum created at the nozzle. This vacuum may create a transport air stream. The compound may be inserted into the transport air stream in a variety of ways including but not limited to physical force (e.g., an auger), pressure, gravity, or vacuum. However, it may be possible to overload the transport air by introducing too much compound (i.e., extreme loading) or too heavy a compound. When extreme loading or moving very heavy solids occurs, additional transport may be needed. As such, in accordance with another embodiment, the transport air may be pressurized coming from the compound feed. For example, the pressurized feed can come from plant instrument air and connect at the transport air valve (612 of FIG. 6 or 712 of FIG. 7) of the compound feed mechanism. Likewise, in some embodiments the nozzle may only create a static or lower pressure condition. In which case the compound may be pumped to the nozzle in order to provide sufficient pressure to overcome the pressure at the nozzle.

In accordance with an exemplary embodiment, fluid may be supplied through a sootblower (step 930). In one example, the fluid supply may be initiated by opening the poppet valve. In accordance with various other exemplary embodiments, the fluid supply may be initiated according to the individual operation of the sootblower or other fluid supply and delivery device.

In accordance with one embodiment of the present invention, the compound may be mixed with the pressurized fluid (step 940). In one exemplary embodiment the compound may be combined with fluid supply into a laminar flow. The compound may be control fed into the transport flow stream. In one exemplary embodiment and with exemplary reference to FIG. 7, valve 708 may be opened after the sootblower is started. In one exemplary embodiment, transport air is pulled by a vacuum through the compound feed mechanism into the sootblower fluid stream. In another exemplary embodiment, the compound is forced through the nozzle by a pump. The pump may be a part of the compound feed mechanism. The compound may be delivered to nozzle 702 in response to the injection nozzle 720 being in the correct location in the interior of the utility furnace. The delivery of the compound may be triggered by activating the transportation device which may be, for example, an auger feeder, transport air, or a pump. As discussed before, the fluid stream pressures at the poppet valve can vary greatly. As such, the chemical injection port pressure (i.e. the fluid pressure after the nozzle) may also vary greatly. The variations may be adapted to by adjusting the pressure created by the pressure device in compound feed mechanism and compound storage mechanism (for example, the pump, auger, and/or transport air). The mixing or infusion may occur after fluid has been running through the sootblower. Due to the nozzle creating a vacuum, the peak impact pressure (i.e. the pressure designed into the sootblower system as measured at the injection nozzle 720 to allow it to effectively move ash in a furnace) may drop. In an exemplary embodiment, this pressure drop is compensated for by readjustment of the poppet valve. This compensation may thus prevent negative effects on the cooling flow of the lance tube and/or the peak impact pressure. Similar, measures may be taken for a mixing chamber. While the mixing chamber may not cause the same pressure drop as the nozzle any pressure drop due to the mixing chamber can be compensated for.

In accordance with one embodiment of the present invention, the mixture of pressurized fluid and compound may then be advantageously supplied to targeted portions of a utility furnace (step 950). Such locations may normally be accessible only by means of the sootblower. For example, referring to FIGS. 2*a*, 2*c*, 2*d*, and 2*e*, various elements away from the wall may be the target. Referring to FIG. 2*b*, the wall may be the target. Furthermore sootblowers are located throughout substantially all of the utility furnace. As such, in various embodiments a user is able to deliver the mixture to a utility furnace through all types of manufactured sootblowers. The use of any sootblower in the utility furnace allows for covering areas accessible by the sootblowers. Furthermore, the delivery of the compound by the sootblowers installed on the utility furnace is possible without relying on flue gas. As such reliance on the changing flue gas flow dynamics is avoided. Ultimately the quantity of chemical delivered can also be minimized through the targeted effort.

In accordance with one embodiment of the present invention, the mixture may react with the targeted elements on the interior of the furnace (step 960). Introducing the compound into a utility furnace may improve the efficiency of the furnace. This is done by impregnating the compound to affected slagging areas and chemically altering the buildup of pollution, slag, or other deleterious elements in furnace. In an exemplary embodiment, the device is configured to more easily remove the slag after first chemically reacting with the slag. In one example, this may allow the furnace to function on less fuel while maintaining substantially similar operating parameters.

In accordance with one embodiment of the present invention, the nozzles may be removed from the sootblower when finished distributing the compound into the furnace (step 970). This will restore the sootblower to its original condition. Once removed the nozzle and compound feed mechanism may be stored for use on the same sootblower or they may be moved to another sootblower. In accordance with another embodiment of the present invention, the nozzle and/or compound feed mechanism may be left in place for future use.

It may be understood herein with regard to the various aspects, embodiments and examples of the present invention, that a compound, for providing environmental benefits to emissions gases, reducing slagging, and/or improving the overall efficiency of a utility furnace, may be injected into the utility furnace through preexisting fluid systems (e.g. compressed air systems) by mixing the compound with the fluid in the fluid systems. The mixture may be injected into the utility furnace through one more of preexisting devices on the furnace including burners, sootblowers, access panels, fuel delivery, etc.

In the following description and/or claims, the terms coupled and/or connected, along with their derivatives, may be used. In particular embodiments, connected may be used to indicate that two or more elements are in direct physical contact with each other. Coupled may mean that two or more elements are in direct physical contact. However, coupled may also mean that two or mare elements may not be in direct contact with each other, but yet may still cooperate and/or interact with each other. Furthermore, couple may mean that two objects are in communication with each other, and/or communicate with each other, such as two pieces of hardware. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

It should be appreciated that the particular implementations shown and described herein are illustrative of various embodiments including its best mode, and are not intended to limit the scope of the present disclosure in any way. Furthermore, the connecting lines shown in the various figures contained herein are intended to represent exemplary functional relationships and/or physical couplings between the various elements. It should be noted that many alternative or additional functional relationships or physical connections may be present in a practical system.

While the principles of the disclosure have been shown in embodiments, many modifications of structure, arrangements, proportions, the elements, materials and components, used in practice, which are particularly adapted for a specific environment and operating requirements without departing from the principles and scope of this disclosure. These and other changes or modifications are intended to be included within the scope of the present disclosure and may be expressed in the following claims.

I claim:

1. A method of providing an emissions improving compound into an exhaust gas stream of a utility furnace system through retrofitted sootblowers, the utility furnace system of the type for combustion of a fuel within a combustion chamber, the utility furnace system having a utility furnace having tubes forming a water wall that forms at least a portion of the combustion chamber of the utility furnace, the method comprising:

retrofitting a sootblower to include a nozzle, the sootblower comprising a feed tube and a valve, and wherein the retrofitting comprises connecting the nozzle between the feed tube and the valve;

attaching an emissions improving compound feed to a compound entrance of the nozzle, wherein the nozzle further comprises an inlet and an exit, wherein the nozzle is located outside of the combustion chamber of the utility furnace, and wherein the nozzle further comprises a varying cross-section between the inlet and the exit, wherein the nozzle has a larger diameter cross-section opening at the inlet than at the exit to cause a pressure differential between the inlet and the exit with the pressure being higher at the inlet than at the exit for drawing the emissions improving compound into the compound entrance, wherein the valve is connected to the inlet, and wherein the feed tube is connected to the exit;

attaching a pressurized fluid supply to the valve;

supplying the emissions improving compound to the nozzle via the emissions improving compound feed;

supplying a pressurized fluid, comprising at least one of steam or air, to the sootblower via the pressurized fluid supply;

mixing, in the sootblower at the nozzle outside of the combustion chamber, the emissions improving compound and the pressurized fluid; and delivering the mixed emissions improving compound and pressurized fluid to an interior of the utility furnace, into the exhaust gas stream of the utility furnace, via the feed tube of the sootblower;

wherein the sootblower is at least one of:

1) a retractable wall blower directing the emissions improving compound, from the retractable wall blower, in a direction generally away from the water wall at a point where the wall blower penetrates the water wall and towards a middle of the utility furnace;

2) a retractable lance, directing the emissions improving compound directly into the exhaust gas stream of the utility furnace at multiple locations across a cross-section of the utility furnace including at locations within the interior of the utility furnace nearer the center of the exhaust gas stream than the edges of the exhaust gas stream; and 3) a rotating element, directing the emissions improving compound directly into the exhaust gas stream of the utility furnace including at a location within the interior of the utility furnace nearer the center of the exhaust gas stream than the edges of the exhaust gas stream.

2. The method of claim 1, wherein the utility furnace is a coal fired or co-fired power plant utility furnace comprising a fire portion, a superheater portion, and a back-pass portion.

3. The method of claim 1, wherein the emissions improving compound chemically reacts directly with harmful byproducts of combustion in the exhaust gas stream to directly reduce emissions harmful to the environment.

4. The method of claim 1, wherein the emissions improving compound is introduced into the utility furnace to aid in encapsulation of harmful byproducts of combustion; wherein the utility furnace is a pulverized coal fired utility furnace.

5. The method of claim 1, wherein the emissions improving compound is injected into the interior of the utility furnace away from the water wall.

6. The method of claim 1, wherein the emissions improving compound is injected into the interior of the utility furnace at locations within the utility furnace, consistently, and irrespective of and without reliance on changing flue gas flow dynamics.

7. A method of providing an emissions improving compound into an exhaust gas stream of a utility furnace system through retrofitted sootblowers, the utility furnace system of the type for combustion of a fuel within a combustion chamber, the utility furnace system having a utility furnace having tubes forming a water wall that forms at least a portion of the combustion chamber of the utility furnace, the method comprising:

retrofitting a sootblower to make a retrofitted sootblower to provide the emissions improving compound into an exhaust gas stream of the utility furnace system, the sootblower having a pressurized fluid supply attached to the sootblower for injecting a pressurized fluid into the utility furnace, the sootblower further comprising a feed tube and a valve, wherein the retrofitting comprises:

separating the feed tube and the valve and inserting and connecting a nozzle between the feed tube and the valve, wherein the nozzle further comprises an inlet, an exit and a compound entrance, wherein the nozzle is located outside of the combustion chamber of the utility furnace, and wherein the nozzle further comprises a varying cross-section between the inlet and the exit, wherein the nozzle has a larger diameter cross-section opening at the inlet than at the exit to cause a pressure differential between the inlet and the exit with the pressure being higher at the inlet than at the exit for drawing the emissions improving compound into the compound entrance;

attaching an emissions improving compound feed to the compound entrance of the nozzle of the retrofitted sootblower;

supplying the emissions improving compound to the compound entrance of the nozzle of the retrofitted sootblower via the emissions improving compound feed;

supplying the pressurized fluid, comprising at least one of steam or air, to the inlet of the nozzle of the retrofitted sootblower via the pressurized fluid supply;

mixing the emissions improving compound and the pressurized fluid at the nozzle in the retrofitted sootblower; and delivering the mixed emissions improving compound and pressurized fluid to an interior of the utility furnace, into the exhaust gas stream of the utility furnace, via the retrofitted sootblower;

wherein the retrofitted sootblower is at least one of:

1) a retractable wall blower directing the emissions improving compound, from the retractable wall blower, in a direction generally away from the water wall at a point where the retractable wall blower penetrates the water wall and towards a middle of the utility furnace;

2) a retractable lance, directing the emissions improving compound directly into the exhaust gas stream of the utility furnace at multiple locations across a cross-section of the utility furnace including at locations within the interior of the utility furnace nearer the center of the exhaust gas stream than the edges of the exhaust gas stream; and 3) a rotating element, directing the emissions improving compound directly into the exhaust gas stream of the utility furnace including at a location within the interior of the utility furnace nearer the center of the exhaust gas stream than the edges of the exhaust gas stream.

8. The method of claim 7, wherein the utility furnace is a coal fired or co-fired power plant utility furnace comprising a fire portion, a superheater portion, and a back-pass portion, wherein the retrofitted soot blower is the retractable wall blower and is located in a portion of the utility furnace associated with the water wall.

9. The method of claim 7, wherein the utility furnace is a coal fired or co-fired power plant utility furnace comprising a fire portion, a superheater portion, and a back-pass portion, wherein the retrofitted soot blower is the retractable lance and is located in the superheater portion or back-pass portion.

* * * * *